US006298611B1

(12) United States Patent
Oliver et al.

(10) Patent No.: US 6,298,611 B1
(45) Date of Patent: Oct. 9, 2001

(54) GROUND ANCHOR WITH SELF-ALIGNING COMPRESSION CAP

(76) Inventors: James Oliver; Evon L. Oliver, both of P.O. Box 9, Hohenwald, TN (US) 38462

( * ) Notice: Subject to any disclaimer, the term of this patent is extended or adjusted under 35 U.S.C. 154(b) by 0 days.

(21) Appl. No.: 09/573,355

(22) Filed: May 17, 2000

(51) Int. Cl.[7] ..... E02D 5/74

(52) U.S. Cl. ..... 52/157; 248/156; 248/545; 256/DIG. 5

(58) Field of Search ..... 52/155, 157, 292; 248/156, 516, 545; 256/36, 64, 58, DIG. 5

(56) References Cited

U.S. PATENT DOCUMENTS

| | | | | |
|---|---|---|---|---|
| 200,217 | * | 2/1878 | Mudgett | 256/58 |
| D. 336,125 | | 6/1993 | Sadler | D21/246 |
| D. 382,034 | | 8/1997 | Dullinger | D22/107 |
| 571,624 | * | 11/1896 | Ryan | 52/157 |
| 3,676,965 | * | 7/1972 | Deike | 52/98 |
| 4,863,137 | | 9/1989 | Cockman et al. | 248/545 |
| 4,923,165 | | 5/1990 | Cockman | 248/545 |
| 5,011,107 | | 4/1991 | Reece | 248/545 |
| 5,113,627 | | 5/1992 | Jarrett | 52/107 |
| 5,123,623 | | 6/1992 | McNamara | 248/545 |
| 5,135,192 | | 8/1992 | Winkler | 248/156 |
| 5,139,235 | | 8/1992 | Kilmer | 256/36 |
| 5,295,766 | | 3/1994 | Tiikkainen | 405/232 |
| 5,649,690 | | 7/1997 | Kilmer | 256/35 |
| 5,697,600 | | 12/1997 | Fingerson et al. | 256/64 |
| 5,884,874 | | 3/1999 | Speece et al. | 248/516 |
| 5,906,077 | | 5/1999 | Andiarena | 52/157 |
| 5,927,677 | | 7/1999 | Speece et al. | 248/516 |
| 5,930,959 | | 8/1999 | Van Halteren | 52/157 |

* cited by examiner

*Primary Examiner*—Carl D. Friedman
*Assistant Examiner*—U. Slack
(74) *Attorney, Agent, or Firm*—Calif Tervo

(57) ABSTRACT

A ground anchor (10) for boring in soil (90) generally includes an elongate shank (20) having auger blades (34) on its lower end (30) and a attachment mechanism (41) on its upper end (40) for attachment of anchor lines (48), a compression cap (60), and a bearing member (80). Compression cap (60) includes a plate (62) that is freely journaled on shank 20 above blades (34) such that plate (62) can freely tilt through a tilt angle to align with surface (91) of soil (90). Bearing member (80) includes a bearing surface (85) adapted for applying coupled bearing forces on compression cap (60) over the tilt angle such that compression cap (60) compresses soil between cap (60) and auger blades (34). In exemplary embodiment, bearing surface (85) is inverse conical or spherical.

19 Claims, 1 Drawing Sheet

GROUND ANCHOR WITH SELF-ALIGNING COMPRESSION CAP

FIELD OF THE INVENTION

This invention relates in general to anchors that are bored into the ground and more specifically to a ground anchor having a cap for compressing soil above an auger, the cap being able to tilt so as to align with the contour of the grade.

BACKGROUND OF THE INVENTION

Ground anchors of the auger type tend to loosen the soil as the auger is screwed into the earth. This tends to make the anchor less stable. Particularly, the anchor shaft may be able to move back and forth laterally in the loosened soil and thereby loosen the anchor such that the anchor becomes ineffective.

Accordingly, there has been a need for an improved ground anchor.

SUMMARY OF THE INVENTION

The invention is a ground anchor for boring in the soil, and it generally includes an elongate shank having an auger on its lower end and a attachment mechanism on its upper end for attachment of anchor lines, a compression cap, and a bearing member.

The compression cap is a generally disk-shaped plate of uniform thickness having an aperture freely journaling it on the shank above the soil such that said plate can freely tilt through a tilt angle to align with the surface of the soil. Preferably, a side slot provides entry of the shaft to the central aperture. The cap has a generally planar downward facing surface for compressing soil between the cap and the auger blades. Preferably, the cap has peripheral side walls extending upwards or downwards from the perimeter of the plate for bearing against the soil for presenting a larger side surface area than the plate for preventing lateral movement.

The bearing member includes a bearing surface adapted for applying bearing forces on the compression cap over the tilt angle of the compression cap such that the downward facing surface of the compression cap compresses soil between the cap and the auger blades. In exemplary embodiment, the bearing surface is inverse conical or spherical.

Other features and many attendant advantages of the invention will become more apparent upon a reading of the following detailed description together with the drawings wherein like reference numerals refer to like parts throughout.

DETAILED DESCRIPTION OF THE INVENTION

Figure 2:
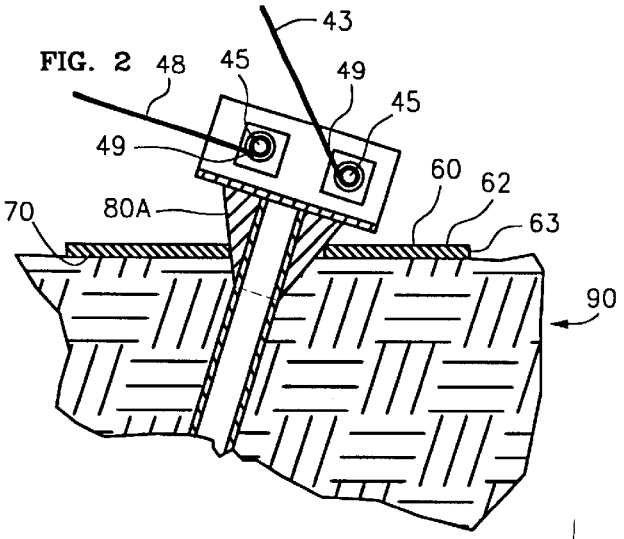
FIG. 2 is an enlarged cross sectional view of the upper end of the anchor of FIG. 1 in the ground.
Figure 1:
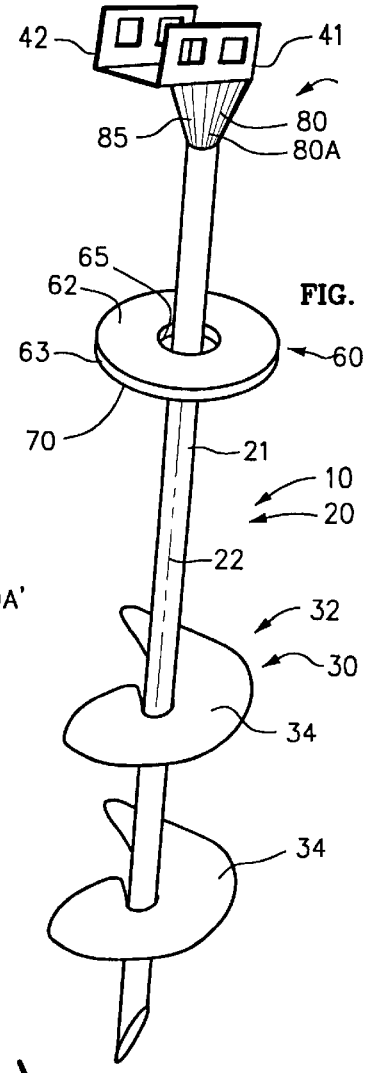
FIG. 1 is a perspective view of a first embodiment of the ground anchor of the invention.
Figure 3:
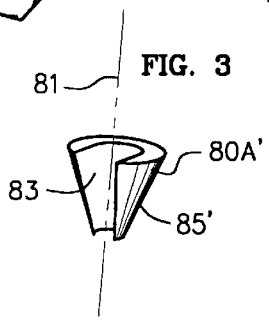
FIG. 3 is a perspective view of a alternate embodiment of the conical bearing member of FIG. 1.

With reference now to the drawings, and first particularly to FIGS. 1–3 thereof, FIG. 1 is a perspective view of a first embodiment of the ground anchor 10 of the invention, FIG. 2 is an enlarged cross sectional view of the upper end 40 of the anchor 10 of FIG. 1 in the ground, such as soil 90, and FIG. 3 is a perspective view of an alternate embodiment of the conical bearing member 80A of FIG. 1.

Ground anchor 10 generally includes a shank 20, a compression cap 60, and a bearing member 80. Shank 20 is an elongate shaft 21, such as a rod or pipe of metal, such as steel, having a longitudinal axis 22. Shank 20 includes a lower end, such as boring end 30, and an upper end 40 including attachment means 41. Boring end 30 includes auger means, 32, such as a helical blade 34, for boring in soil 90. Auger means 32 shown is a pair of helical blades 34 attached, such as by any suitable means, such as welding, to shaft 21. Alternately, auger 32 may be any means capable of boring shank into soil 90. Blades 34 have a maximum radius. Thus, as blades 34 bore in soil 90, soil 90 is loosened over a circle of known maximum diameter, that is, a diameter of twice the maximum radius.

Attachment means 41 on upper end 40 of shank 20 includes attachment bracket 42 for attachment of one or more anchor lines 48. Anchor lines 48 have a lower end 49 wrapped on a tensioning bolt 45 as is well-known in the art. Shank 20 is shown bored into soil 90 at an angle which is typically about fifteen degrees or more with upper end 40 further from the object to be anchored such that the tension forces in anchor lines 48 tend to pull upper end 40 sideways toward the object.

Compression cap 60 includes a generally disk-shaped plate 62 of generally uniform thickness and having a perimeter 63. Cap 60 includes an aperture, such as central aperture 65 freely journaling plate 62 on shank 20 above soil 90 such that plate 62 can freely tilt through a tilt angle of at least fifteen degrees. Thus, aperture 65 is larger than the cross-sectional area of shaft 21. Cap 60 includes a generally planar downward facing surface 70 for compressing soil 90 between cap 60 and auger means 32.

Figure 4:
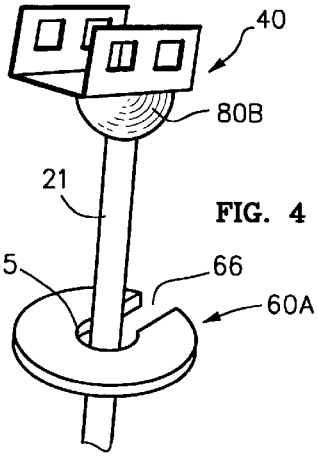
FIG. 4 is a perspective view of an alternate upper end showing a spherical bearing member and an attachable bearing cap.
Figure 5:
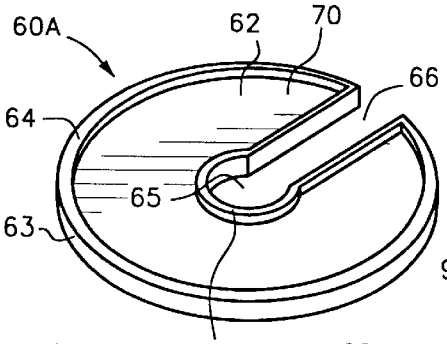
FIG. 5 is an enlarged bottom perspective view of the compression cap of FIG. 4.

FIGS. 4 and 5 show an alternate compression cap 60A. FIG. 4 is a perspective view of the top of cap 60A, and FIG. 5 is an enlarged bottom perspective view of the compression cap 60A of FIG. 4. Cap 60A is similar to cap 60, as described above, but includes a radial slot 66 for providing side entry of shaft 21 to central aperture 65 such that cap 60A can easily be attached to shaft 21 after shaft 21 has been bored most of the way into soil 90. In this manner, cap 60A is not in the way during boring.

Cap 60 includes side wall means, such as side wall 64, extending upwards or downwards (as shown) from perimeter 63 of plate 62 for presenting a larger side surface area than plate 62 to aid in preventing lateral movement of cap 60A and shaft thru soil 90.

Preferably, compression cap 60 has a radius approximating that of the maximum radius of the blades 34.

Bearing member 80, such as conical bearing member 80A is mounted on upper end 40 of shank 20. Conical bearing 80A may be attached, such as by welding, directly to the upper end of shaft 21. Alternatively, conical bearing 80A may be the frustrum of an inverse truncated cone having a central vertical bore for receiving shaft 21 or, as seen a FIG. 3, a conical bearing 80A' may be the frustrum of an inverse cone having a longitudinal axis 81 and a vertical side mounting slot 83 for receiving shaft 21 for mounting bearing 80A' on shank 20. Slotted conical bearing 80A' can be easily attached and removed from shaft 21 at any time.

Bearing member 80, such as conical bearing member 80A is mounted on upper end 40 of shank 20. Conical bearing 80A may be attached, such as by welding, directly to the upper end of shaft 21. Alternatively, conical bearing 80A may be the frustum of an inverse truncated cone having a central vertical bore for receiving shaft 21 or, as seen a FIG. 3, a conical bearing 80A' may be the frustum of an inverse cone having a longitudinal axis 81 and a vertical side mounting slot 83 for receiving shaft 21 for mounting bearing 80A' on shank 20. Slotted conical bearing 80A' can be easily attached and removed from shaft 21 at any time.

Figure 7:
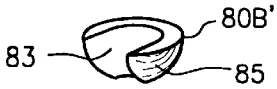
FIG. 7 is an alternate embodiment of spherical bearing of FIG. 4.
Figure 6:
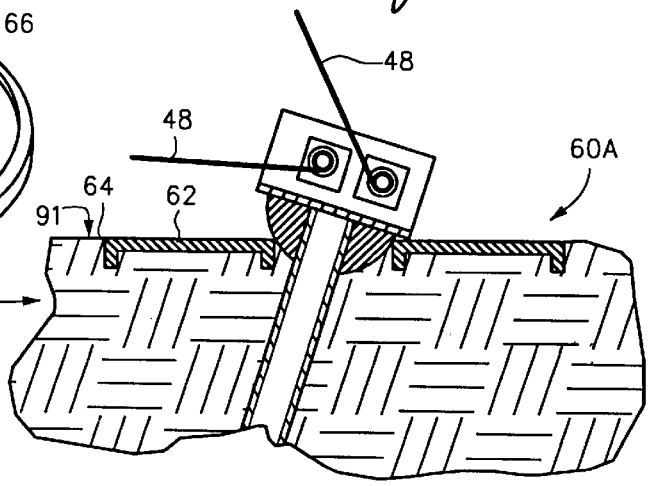
FIG. 6 is an enlarged cross sectional view of the upper end of the anchor of FIG. 4 in the ground.

FIGS. 4, 6 and 7 show an alternate bearing member, spherical bearing member 80B. FIG. 4 is a perspective view of an alternate upper end 40 showing spherical bearing member 80B on shaft 21. FIG. 6 is an enlarged cross sectional view of the upper end of the anchor of FIG. 4 in the ground. FIG. 7 is an alternate embodiment 80B' of spherical bearing 80B of FIG. 4.

Spherical bearing member 80B is mounted on upper end 40 of shank 20. Bearing member 80B may be a section of a sphere, such as a hemisphere or less, having a bearing surface 85' which is a section of a sphere. Bearing 80B may be attached, such as by welding, directly to the upper end of shaft 21. Alternatively, bearing 80B may have a central vertical bore for receiving shaft 21 or, as seen in FIG. 7, may have a vertical side mounting slot 83 for receiving shaft 21 for mounting bearing 80B on shank 20. Slotted spherical bearing 80B' can be easily attached and removed from shaft 21 at any time. Bearing surface 85' bears uniformly on the rim 67 of central aperture 65 such that cap 60A is uniformly pushed down after initially aligning with the surface of soil 90.

As an example of a preferred use, a shank 20 with no bearing member and no cap is bored in soil 90 until the auger blades 34 are under soil 90 or until upper end 40 nears soil surface 91. Then, cap 60, such as cap 60A, is slid onto shaft 21 just above soil surface 91 and rested on soil surface 91 so as to align with the contour of the grade. Then, a bearing 80, such as 80B' , is slid on shaft and rested on cap 60A. Shank 20 is then bored into soil 90 until tight, that is until attachment bracket 42 bears on bearing member 80 and before further turning will strip the bored hole. Preferably, shank 20 is bored in until side wall 64 of cap 60A bears against soil 90.

Having described the invention, it can be seen that it provides a very convenient apparatus for efficient and reliable ground anchoring.

Although particular embodiments of the invention have been illustrated and described, various changes may be made in the form, composition, construction, and arrangement of the parts herein without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A ground anchor including:

an elongate shank including:

a boring end having a longitudinal axis; said boring end including:

auger means for boring in the soil; and an upper end including:

attachment means for attachment of an anchor line;

a compression cap including:

a central aperture freely journaling said cap on said shank above the soil and such that said cap can freely tilt through a tilt angle of at least fifteen degrees relative to the longitudinal axis of said boring end; and a downward facing surface for compressing soil between said cap and said auger means; and a bearing member mounted on said upper end of said shank; said bearing member including:

a bearing surface for bearing against said compression cap and adapted for applying bearing forces on said compression cap over the tilt angle of said compression cap such that said downward facing surface of said compression cap compresses soil between said cap and said auger means.

2. The ground anchor of claim 1 wherein:

said bearing means is attached to said shank.

3. The ground anchor of claim 1 wherein:

said bearing surface of said bearing member is inverse conical.

4. The ground anchor of claim 1 wherein:

said bearing member is the frustum of an inverse cone having a vertical central bore mounted on said shank.

5. The ground anchor of claim 1 wherein:

said bearing member is the frustum of an inverse cone having a longitudinal axis and a vertical side mounting slot for receiving said shank for mounting said bearing member on said shank.

6. The ground anchor of claim 1 wherein:

said compression cap includes a slot providing entry of said shaft to said central aperture.

7. The ground anchor of claim 1 wherein:

said bearing surface of said bearing member is a spherical section.

8. The ground anchor of claim 1 wherein:

said bearing member is a spherical section having a vertical central bore mounted on said shank.

9. The ground anchor of claim 1 wherein:

said bearing member is a spherical section having a vertical side mounting slot for receiving said shank for mounting said bearing member on said shank.

10. The ground anchor of claim 1 wherein:

said compression cap includes a side mounting slot providing entry of said shaft to said central aperture.

11. The ground anchor of claim 1 wherein:

said auger means includes:

a helical blade having a maximum radius; and wherein said compression cap has a radius approximating that of the maximum radius of said blade.

12. A ground anchor including:

an elongate shank including:

a boring end having a longitudinal axis; said boring end including:

auger means for boring in the soil including:

a helical blade having a maximum radius; and an upper end including:

attachment means for attachment of an anchor line;

a compression cap including:

a generally disk-shaped plate generally uniform thickness and having a perimeter; said plate including:

an aperture freely journaling said plate on said shank above the soil and such that said plate can freely tilt through a tilt angle of at least fifteen degrees relative to the longitudinal axis of said boring end;

a generally planar downward facing surface for compressing soil between said cap and said auger means; and side wall means extending upwards or downwards from said plate; said side wall means for bearing against the soil for presenting a larger side surface area than said plate for preventing lateral movement;

a bearing member mounted on said upper end of said shank; said bearing member including:

a bearing surface for bearing against said compression cap and adapted for applying bearing forces on said compression cap over the tilt angle of said compression cap such that said downward facing surface of said compression cap compresses soil between said cap and said auger means.

13. The ground anchor of claim 12 wherein:

said bearing surface of said bearing member is inverse conical.

14. The ground anchor of claim 12 wherein:

said bearing member is the frustum of an inverse cone having a longitudinal axis and a vertical side mounting slot for receiving said shank for mounting said bearing member on said shank.

15. The ground anchor of claim 12 wherein:

said compression cap includes a slot providing entry of said shaft to said aperture.

16. The ground anchor of claim 12 wherein:

said bearing surface of said bearing member is a spherical section.

17. The ground anchor of claim 12 wherein:

said bearing member is a spherical section having a vertical side mounting slot for receiving said shank for mounting said bearing member on said shank.

18. The ground anchor of claim 12 wherein:

said compression cap includes a side mounting slot providing entry of said shaft to said aperture.

19. The ground anchor of claim 12 wherein:

said auger means includes:

a helical blade having a maximum radius; and wherein said compression cap has a radius approximating that of the maximum radius of said blade.

* * * * *